US005143133A

United States Patent [19]

Speckman

[11] Patent Number: 5,143,133

[45] Date of Patent: Sep. 1, 1992

[54] FURNITURE COVERING FOR SHIPMENT

[75] Inventor: Mark C. Speckman, Greensboro, N.C.

[73] Assignee: U.S. Packaging, Inc., High Point, N.C.

[21] Appl. No.: 823,160

[22] Filed: Jan. 21, 1992

[51] Int. Cl.[5] ..... B65D 30/08

[52] U.S. Cl. ..... 150/158; 206/326; 206/521; 229/87.02; 383/1; 428/165; 428/535; 428/536

[58] Field of Search ..... 150/158, 165, 166; 383/1; 229/87.02; 206/521, 326; 428/165, 535, 536

[56] References Cited

U.S. PATENT DOCUMENTS

| | | | |
|---|---|---|---|
| 1,691,379 | 11/1928 | Christ, Jr. | 206/326 |
| 1,915,416 | 6/1933 | Hall, Jr. | 428/165 |
| 2,306,987 | 12/1942 | Yount | 150/158 |
| 2,378,932 | 6/1945 | Kirby | 206/521 |
| 3,203,618 | 8/1965 | Andrews et al. | 229/87.02 |
| 3,279,511 | 10/1966 | Griffin, Jr. | 383/1 |
| 3,506,049 | 4/1970 | Gerard | 150/158 |
| 3,660,958 | 5/1972 | Garrison | 229/87.02 |

*Primary Examiner*—Stephen P. Garbe

*Attorney, Agent, or Firm*—Shefte, Pinckney & Sawyer

[57] ABSTRACT

A covering for furniture during shipment thereof is comprised of a flexible sheet material constructed of a multiplicity of plys utilizing easily recyclable material and is folded into a configuration having free ends stitched shut whereby the covering may be placed over a furniture item for protection during shipment thereof.

1 Claim, 2 Drawing Sheets

FURNITURE COVERING FOR SHIPMENT

BACKGROUND OF THE INVENTION

The present invention relates to coverings for furniture formed of flexible material and open at one end for containing furniture during shipment and for offering protection to the furniture contained therein, and particularly to coverings of this type which are formed of juxtaposed layers of flexible materials in sheet form and which are folded into the requisite shape for covering furniture.

It is conventional practice for furniture manufacturers to utilize a collapsible covering, open on one end, to cover furniture for shipment. A proper covering must be resistant to tearing, padded, easily opened, and must offer an inner surface which is non-damaging to the furniture contained therein. Conventional coverings have offered these features in a disposable format.

A typical covering is formed of layered materials including an inner surface of polyethylene which is smooth, thus preventing so-called "rub" damage to the furniture. Additional layers include roughened paper which provides a cushioned effect and an outside layer of 50# extensible wet strength paper to protect the furniture from wetness and tearing. Typically, the material is formed into sheets having the layers adhered to one another at the edges using hot melt glue, folded into shape and sewn together using nylon thread at the edges to form the collapsible covering.

While this type of bag construction can be effective as a furniture covering, it has significant drawbacks from an environmental standpoint. Typically, these coverings are used once, then discarded, which results in a sizable waste of materials, particularly when the coverings are large enough to cover large pieces of furniture.

As with other single use goods, recycling has become a way to reuse raw materials and eliminate waste, the disposal of which is becoming increasingly difficult. The currently used furniture coverings offer limited possibilities of recycling. The inner layer of polyethylene, while possibly recyclable, is of a different material than the rest of the covering and must be separated from the rest of the covering prior to any attempts at recycling. In addition, wet strength paper is difficult to recycle and the nylon thread utilized to sew the edges together is of a different material than either the inner layer or the rest of the covering. In sum, current furniture covering construction prevents easily recycling the material used therein. The disparate material used, as well as the method of attaching the materials together, discourages rather than encourages recycling efforts.

SUMMARY OF THE INVENTION

It is accordingly an object of the present invention to provide a furniture covering which solves the aforementioned problems. Specifically, it is an object of the present invention to provide a furniture covering for shipment which is constructed of materials that are easily recyclable by the ultimate user, thus providing more efficient use of materials and which functions in the usual manner to properly protect the furniture during shipment and handling.

The furniture covering of the present invention provides a collapsible covering for protection of furniture during shipment which includes a sheet of flexible material formed into a generally parallelepipedic configuration having a plurality of wall panel portions. The wall panels portions are joined at one end thereof to provide an open end portion and a closed end portion whereby the placement of the covering over a furniture item will result in the wall panels assuming an open disposition having first and second gussets formed in said wall panels whereby said closed end portion forms a generally flat surface adjacent the furniture item.

The flexible material includes a plurality of plys juxtaposed and attached to one another to form the sheet. The plys are formed of recyclable materials, including a first outer ply formed of extensible kraft paper and an inner ply formed of glassine paper, a first plurality of intermediate plys formed of recycled indented kraft paper, and at least one additional intermediate ply formed of extensible kraft paper. All of the plys are joined together using a water soluble adhesive and the wall panels are joined together by stitching consisting of natural fibers.

DESCRIPTION OF THE PREFERRED EMBODIMENT

Figure 1:
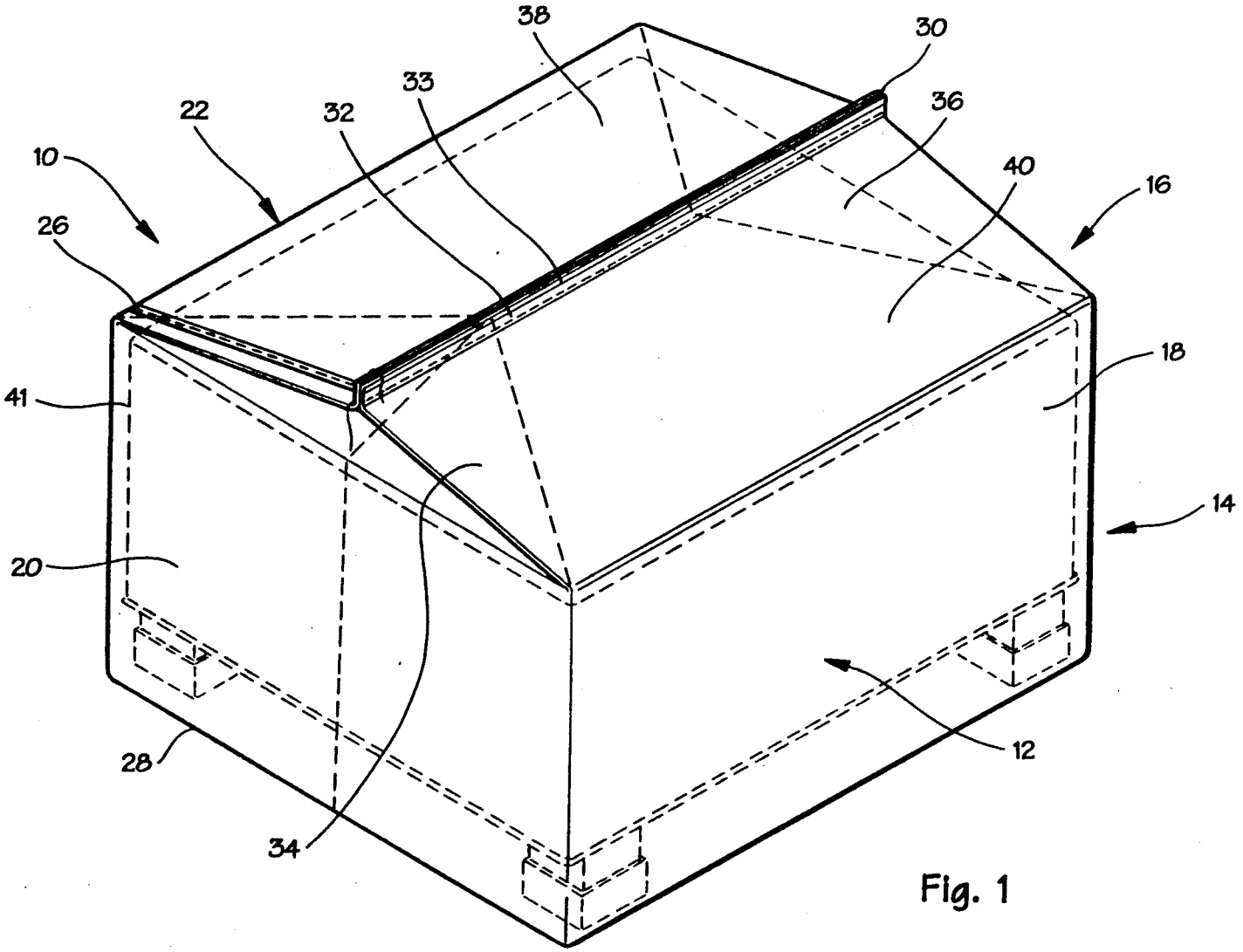
FIG. 1 is a perspective view of a covering for furniture during shipment according to the preferred embodiment of the present invention.

Referring now to the accompanying drawings and more particularly to FIG. 1, a covering for furniture during shipment according to the preferred embodiment of the present invention is indicated generally at 10. The covering consists of a sheet of flexible material 12 which is folded and stitched into a bag-like shape for covering furniture. The sheet 12 is constructed of several individual plys of material which will be described in detail presently.

Figure 2:
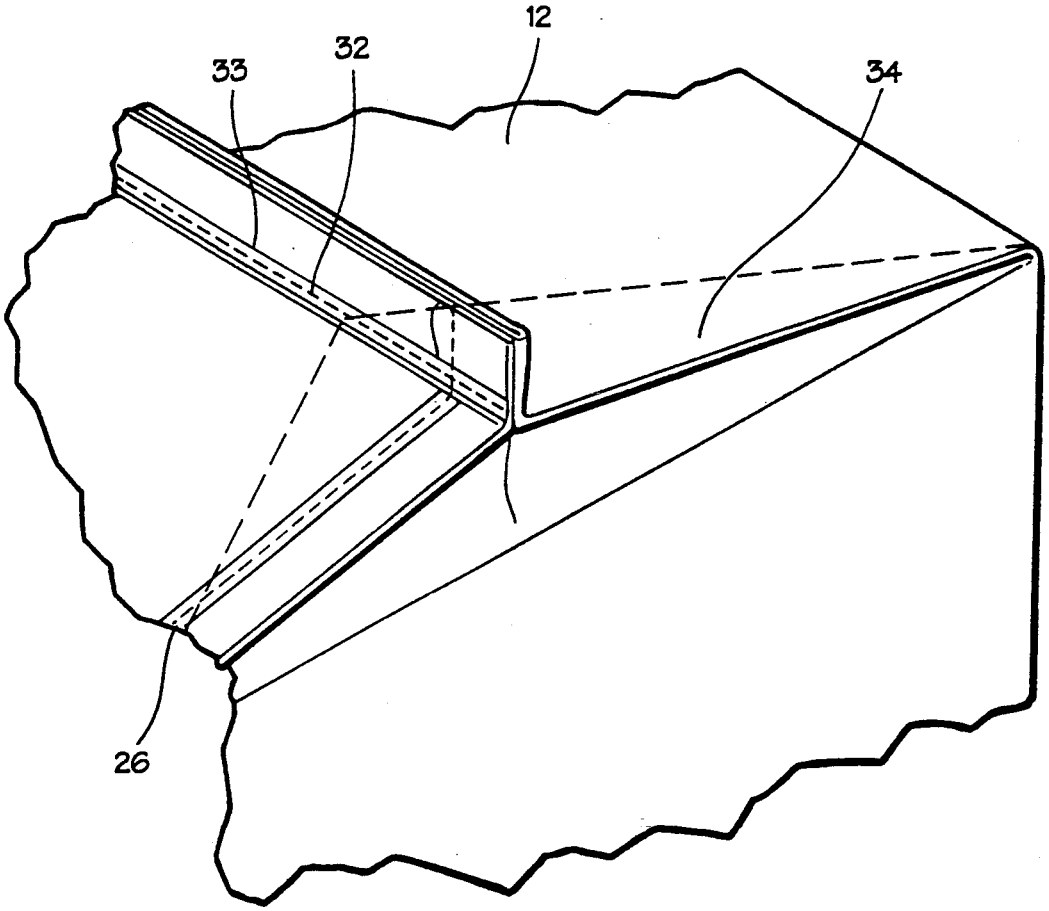
FIG. 2 is a partial sectional view of the covering for furniture as illustrated in FIG. 1 showing the stitching at a junction of the wall panels thereof.

To form the covering for furniture of the present invention, a sheet of flexible material 12 is initially folded into a tubular configuration using stitching 26 to close the open ends. It is preferred that the stitching 26 consist of "Easy Open 101" stitch manufactured by the Dave Fiechbien Company of Minneapolis, Minn. This stitching 26 utilizes natural fibers, such as cotton, which readily lend themselves to the recycling process. The tubular configuration is shaped in a conventional manner to form the cover 10 as illustrated in FIGS. 1 and 2. The covering 10 has a conventional shape and configuration that, in an open disposition, includes a generally rectangular portion 14 having four side wall portions 16, 18, 20, 22, an open lower end portion 28, and an upper portion 30 which is stitched together using stitching 32 of the type previously mentioned. Gussets 34, 36 are formed on two side wall portions 16, 20 allowing the covering 10 to form two generally flat upper panels 38, 40 when the covering 10 is placed over a furniture item 41 for shipment thereof.

With reference to FIG. 2, the "Easy Open 101" stitching, as previously mentioned, includes stitching of natural fiber 32 and a conventional tear strip 33 located intermediate the stitching 32 and the sheet material 12. The stitching 32 may be opened by pulling the tear strip 33 away from the sheet material 12 thereby removing the stitching 32 along with the tear strip 33.

Figure 3:
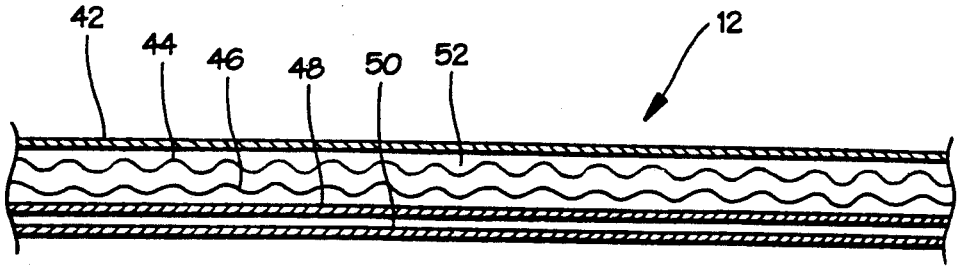
FIG. 3 is a cross-sectional view of the materials of the covering for furniture illustrated in FIG. 1.

Referring now to FIG. 3, it can be seen that the sheet material 12 is formed of a multiplicity of plys consisting of different recyclable materials. It is preferred that the outer ply 42 consist of 50# extensible kraft paper. The next two inboard plys 44, 46 preferably consist of 40# recycled indented kraft paper for cushioning effect. The next innermost ply 48 preferably consists of 50# extensible kraft paper for strength. The innermost ply 50, the inner surface of which contacts the furniture surface, consists preferably of 43# glassine paper providing a smooth surface to prevent rub damage to the furniture within the covering 10. The layers are adhered together utilizing a water soluble adhesive 52. It should be noted that FIG. 3 illustrates the various plys an exaggerated distance away from one another for clarity.

Typically, the furniture coverings 10 are stored in a flattened disposition until they are needed for use. With reference to FIG. 1, when a furniture covering 10 is utilized to protect a furniture item during shipment, it is expanded into an open disposition and placed over a furniture item 41 utilizing the open end portion 28 of the covering 10. The closed end portion 30 of the covering 10 rests on top of the furniture item 41 and the upper panels 38, 40 of the covering 10 fold generally flat against the top of the furniture item 41. The furniture is then protected for shipment thereof by a covering 10 which is made of materials which are easily recycled by the ultimate user.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A collapsible covering for protection of furniture during shipment comprising a sheet of flexible material formed into a generally parallelepipedic configuration having a plurality of wall panel portions, said wall panel portions being joined to provide an open end portion and a closed end portion, whereby the placement of said covering over a furniture item will result in said wall panels assuming an open disposition having first and second gussets formed in said wall panels whereby said closed end portion forms a generally flat surface on said furniture item, said flexible material having a plurality of plys juxtaposed and attached to one another to form said sheet, said plys formed of recyclable materials including a first outer ply formed of extensible kraft paper, an inner ply formed of glassine paper, a first plurality of intermediate plys formed of recycled indented kraft paper, and at least one additional intermediate ply formed of extensible kraft paper, all of said plys being joined together using a water soluble adhesive, and said wall panels being joined together by stitching consisting of natural fibers.

* * * * *